US010136216B2

(12) United States Patent
Cengarle et al.

(10) Patent No.: US 10,136,216 B2
(45) Date of Patent: Nov. 20, 2018

(54) ACTION SOUND CAPTURE USING SUBSURFACE MICROPHONES

(71) Applicants: DOLBY LABORATORIES LICENSING CORPORATION, San Francisco, CA (US); DOLBY INTERNATIONAL AB, Amsterdam Zuidoost (NL)

(72) Inventors: Giulio Cengarle, Barcelona (ES); Antonio Mateos Sole, Barcelona (ES); Natanael David Olaiz, Barcelona (ES); Kenneth Robert Hunold, Hackettstown, NJ (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/564,421

(22) PCT Filed: Apr. 8, 2016

(86) PCT No.: PCT/US2016/026701

§ 371 (c)(1),
(2) Date: Oct. 4, 2017

(87) PCT Pub. No.: WO2016/164760

PCT Pub. Date: Oct. 13, 2016

(65) Prior Publication Data

US 2018/0139535 A1 May 17, 2018

Related U.S. Application Data

(60) Provisional application No. 62/183,563, filed on Jun. 23, 2015.

(30) Foreign Application Priority Data

Apr. 10, 2015 (ES) ..... 201530479
Jul. 7, 2015 (EP) ..... 15175681

(51) Int. Cl.
*H04R 3/00* (2006.01)
*H04R 5/027* (2006.01)
*A63B 24/00* (2006.01)

(52) U.S. Cl.
CPC ..... *H04R 3/005* (2013.01); *H04R 5/027* (2013.01); *A63B 2024/004* (2013.01); *H04R 2201/401* (2013.01); *H04R 2201/405* (2013.01)

(58) Field of Classification Search
USPC ..... 381/1, 26, 92, 310, 344, 361, 157, 168, 381/169
See application file for complete search history.

(56) References Cited

U.S. PATENT DOCUMENTS 4,752,961 A 6/1988 Kahn
6,055,417 A 4/2000 Hill
(Continued)

FOREIGN PATENT DOCUMENTS

EP 2421182 2/2012
WO 2007/037700 4/2007
(Continued)

OTHER PUBLICATIONS

Cengarle, G. et al "A New Technology for the Assisted Mixing of Sport Events: Application to Live Football Broadcasting" AES presented at the 128th Convention, London, UK, May 22-25, 2010.
(Continued)

*Primary Examiner* — Yosef K Laekemariam

(57) ABSTRACT

Methods and systems for generating an audio mix indicative of action sound captured at an event on a surface (e.g., a sporting event on a field) using a microphone array, where
(Continued)

the array includes subsurface microphones (e.g., a large number of subsurface microphones) positioned under the surface, and optionally also other microphones. In typical embodiments, at least one point of interest ("PI") on the surface is selected in an automated manner, PI data indicative of a currently selected PI on the surface is generated (e.g., a sequence of PIs on the surface is selected, the PI data is indicative of the sequence of PIs, and a most recently selected PI in the sequence is the currently selected PI), and the audio mix is generated in response to the PI data. Aspects include methods performed by any embodiment of the system, and a system or device configured (e.g., programmed) to perform any embodiment of the method.

17 Claims, 3 Drawing Sheets

(56) References Cited

U.S. PATENT DOCUMENTS

| | | | | |
|---|---|---|---|---|
| 8,959,555 | B2 | 2/2015 | Monari | |
| 2003/0053634 | A1* | 3/2003 | McGrath | H04S 3/00 381/26 |

FOREIGN PATENT DOCUMENTS

| | | | | |
|---|---|---|---|---|
| WO | 2011/087770 | | 7/2011 | |
| WO | WO 2011/087770 | * | 7/2011 | H04R 19/016 |
| WO | 2011/119401 | | 9/2011 | |
| WO | 2014/165326 | | 10/2014 | |

OTHER PUBLICATIONS

Wikipedia Parabolic Microphone, last edited on Jun. 11, 2016.
Calrec Soccer Sidekick, http://www.fast-and-wide.com/mobile-applications/4837-calrec-soccer-sidekick.
Scopece, Leonardo "Riprese Olofoniche E Ambisoniche II Sistema 3D-VMS" LeMiniSerie, Electtronica, 2011.
ABC Enhances 2002 MLS All-Star Broadcast, Jul. 30, 2002 http://www.ussoccer.com/stories/2014/03/17/11/28/abc-enhances-2002-mls-all-star-broadcast.
Oldfield, R.G. et al "Automatic Mixing and Tracking of On-Pitch Football Action for Television Broadcasts" AES Presented at the 130th Convention, May 13-16, 2011, London, UK.
Batke, J.M. et al "Spatial Audio Processing for Interactive TV Services" AES presented at the 130th Convention, May 13-16, 2011, London, UK, pp. 1-11.
Live Production "Microphone Usage for Sports Broadcasting" http://www.live-production.tv/case-studies/production-facilities/microphone-usage-sports-broadcasting.html.
Hinata, T. et al "Live Production of 22.2 Multichannel Sound for Sports Programs" 40th International Conference, Spatial Audio: Sense the Sound of Space; Oct. 8, 2010.

* cited by examiner

ACTION SOUND CAPTURE USING SUBSURFACE MICROPHONES

CROSS-REFERENCE TO RELATED APPLICATIONS

This application claims priority to Spanish Patent Application No. P201530479, filed on Apr. 10, 2015, U.S. Provisional Patent Application No. 62/143,478, filed on Jun. 23, 2015 and European Patent Application No. 15175681.4, filed on Jul. 7, 2015, each of which is incorporated herein by reference in its entirety.

TECHNICAL FIELD

The example embodiments disclosed herein pertains to capturing sound at an event on a surface (e.g., a sporting event on a field) using microphones positioned under the surface, and generating an audio mix (e.g., a mono mix) of the captured sound indicative of spatially localized action occurring (at a location or sequence of locations on the surface) during the event. Some embodiments include a step of generating an audio program including audio content indicative of the mix of captured sound (e.g., the program is an object based audio program including at least one object channel, and related metadata, indicative of the mix), so that the program can be rendered to provide a perception of the spatially localized action (e.g., action at a location, or along a trajectory, on the surface).

BACKGROUND

Herein, the expression "action sound" is used to denote sound indicative of spatially localized action occurring, during an event on a surface (e.g., a sporting event on a field), at a location (sometimes referred to herein as a "point of interest" or "PI") on the surface. In this context, action occurring "at" a location on the surface denotes action occurring on or above the location. For example, action sound may be sound (e.g., a ball strike) generated on or above a location on a field, during a sporting event on the field, by one or more sporting event participants.

In sports broadcasting, action sound (e.g., ball strikes and other sounds by sporting event participants) is the most sought-after feature, yet often the most difficult to capture, due to the high level of unwanted sounds (e.g., crowd noise) and the unfeasibility of using close-miking.

In accordance with typical practice for capturing sound indicative of the action at a sporting event (e.g., soccer or football game) on a field (sometimes referred to as a pitch), a number of directional microphones (e.g., about twelve directional microphones) are located outside the edges of the field, and their output signals are manually mixed so that the largest gain is applied to the output(s) of the microphone(s) closer to the action (or pointing at it), while less gain is applied to the outputs of the others. This conventional sound capture method produces sub-optimal results and has disadvantages and limitations including the following:

- Stress for the mixing engineer who must follow the action manually (e.g., with fingers on faders of a console);
- Lack of scalability, in the sense that adding more microphones is unfeasible (too complex to mix); and
- Poor action sound quality (adding more microphones at the side or end of a field doesn't improve the quality with which sound can be captured from inner areas of the field).

Other conventional techniques for capturing sound indicative of action at an event (e.g., sporting event) on a field include using microphones (e.g., parabolic microphones or other hyper-directional microphones or microphone arrays (e.g., spherical or cylindrical)) located outside (e.g., along the side(s) and/or end(s) of) the field; and performing semi-automated mixing of the microphone output signals by controlling the gains applied to the output signals in response to tracking a (e.g., manually specifying a time-varying) point of interest ("PI") on the field in real time during the event. Typically, a programmed processor system operates (in response to data indicative of the current PI) to determine automatically a mix of the microphone outputs in which the largest gain is applied to the output(s) of the microphone(s) closest to the current PI (or pointing at it) and less gain is applied to the outputs of the others.

An example of such semi-automated mixing of microphone signals is described in the paper "A New Technology for the Assisted Mixing of Sport Events: Application to Live Football Broadcasting," by Giulio Cengarle, Toni Mateos, Natanael Olaiz, and Pau Arumi, Audio Engineering Society Paper No. 8037, published on May 1, 2010 (the "Cengarle paper"). As described in the Cengarle paper, microphones are positioned around a field. During a sporting event (e.g., a football or soccer game) on the field, a mixing engineer manually specifies a time-varying or time-invariant point of interest ("PI") on the field (e.g., a sequence of different regions on the field at which action of interest is occurring) using a graphic user interface of a mixing system. The graphic user interface (e.g., implemented using a touch screen) displays a representation of the field, with a representation of the currently selected PI superimposed thereon. By manually controlling the position of the PI representation, the engineer specifies the currently selected PI. The mixing system is programmed to mix the outputs of the microphones (in response to data indicative of the current PI) to generate an audio mix which can be rendered (for playback by a loudspeaker or loudspeaker array) to provide a perception of sound (captured by all or some of the microphones) emitted at the spatial location corresponding to the currently selected PI (or a sequence of spatial locations corresponding to a time-varying selected PI). The mixing determines a gain to be applied to the output of each microphone in accordance with an algorithm whose parameters include: a parameter indicative of the physical distance between the microphone and the current PI; and another parameter indicative of whether only the outputs of microphones nearest to the PI (or the outputs of all of the microphones) should effectively participate in the mix. During sound capture, the engineer may for example use the user interface to control (e.g., vary as desired) the location of the PI while the mixing system automatically determines a corresponding mix of outputs of the microphones.

The method described in the Cengarle paper ameliorates one of the above-mentioned disadvantages of conventional sound capture: it reduces the stress on the engineer by automating part of his job. However, the inventors have recognized that since the Cengarle paper teaches positioning the action sound capturing microphones around the field, the method described therein does not ameliorate the fact that faraway microphones (microphones far from a selected PI) are typically used in an effort to capture action sound produced on the field during an event. Thus, the inventors have recognized that the method may generate a mix which is not indicative of the action sound (desired to be captured) or which is indicative of the action sound only with very low quality. Typical example embodiments disclosed herein address this limitation of the method described in the Cengarle paper, and generate a mix indicative with good quality of action sound while automating most of the signal processing required to generate the mix.

In some example embodiments disclosed herein, an audio mix (indicative of action sound emitted at a location or sequence of locations on a surface) is generated using subsurface microphones, and the mix is delivered (with corresponding metadata indicative of the location(s)) as an object channel of an object based audio program, which can be rendered to provide a perception (e.g., rendered for playback by an array of loudspeakers to provide an immersive perception) of the action sound.

Methods for generating and rendering object based audio programs are known. During generation of such programs, it may be assumed that the loudspeakers to be employed for rendering are located in arbitrary locations in the playback environment (or that the speakers are in a symmetric configuration in a unit circle). It need not be assumed that the speakers are necessarily in a (nominally) horizontal plane or in any other predetermined arrangements known at the time of program generation. Typically, metadata included in the program indicates rendering parameters for rendering at least one object of the program at an apparent spatial location or along a trajectory (in a three dimensional volume), e.g., using a three-dimensional array of speakers. For example, an object channel of the program may have corresponding metadata indicating a three-dimensional trajectory of apparent spatial positions at which the object (indicated by the object channel) is to be rendered. Examples of rendering of object based audio programs are described, for example, in PCT International Application No. PCT/US2001/028783, published under International Publication No. WO 2011/119401 A2 on Sep. 29, 2011, and assigned to Dolby Laboratories Licensing Corporation, the contents of which are incorporated herein in there entirety and PCT International Application No. PCT/US2014/031246, published under International Publication No. WO 2014/165326A1 on Oct. 9, 2014, and assigned to Dolby Laboratories Licensing Corporation and Dolby International AB, the contents of which are incorporated herein in there entirety.

Above-cited PCT Application Publication No. WO 2014/165326A1 describes object based audio programs which are rendered so as to provide an immersive, personalizable perception of the program's audio content. The content may be indicative of the atmosphere and/or action (e.g., game action) at and/or commentary on a spectator event (e.g., a soccer or rugby game, or another sporting event). The audio content of the program may be indicative of multiple audio object channels (e.g., indicative of user-selectable objects or object sets, and typically also a default set of objects to be rendered in the absence of object selection by the user) and at least one bed of speaker channels. For example, the object channels may include an object channel (which may be selected, with corresponding metadata, for rendering) indicative of commentary by an announcer, and a pair of object channels (which may be selected, with corresponding metadata, for rendering) indicative of left and right channels of sound produced by a game ball as it is struck by sporting event participants. The bed of speaker channels may be a conventional mix (e.g., a 5.1 channel mix) of speaker channels of a type that might be included in a conventional broadcast program which does not include an object channel.

BRIEF DESCRIPTION

In a class of example embodiments disclosed herein there is a method for generating a mix indicative of action sound captured at an event on a surface (e.g., a sporting event on a field), including steps of:

(a) capturing the action sound using a microphone array, said array including subsurface microphones (e.g., a large number of subsurface microphones) positioned under the surface;

(b) in an automated manner, selecting at least one point of interest ("PI") on the surface and generating PI data indicative of a currently selected PI on the surface (e.g., selecting a sequence of PIs on the surface, and generating the PI data to be indicative of the sequence of PIs, where a most recently selected PI in the sequence is the currently selected PI); and (c) in response to the PI data, generating an audio mix from outputs of the microphones including at least one (e.g., more than one) of the subsurface microphones, such that the audio mix is indicative of action sound emitted at the currently selected PI on the surface.

Typically, the audio mix can be rendered (for playback by a loudspeaker or loudspeaker array) to provide a perception of action sound (captured by at least one of the subsurface microphones) emitted at the spatial location the surface corresponding to the currently selected PI (or a sequence of spatial locations corresponding to a sequence of selected PIs). Typically, the audio mix is a mono mix. Some embodiments include a step of generating (e.g., using a broadcast console) an audio program including audio content indicative of the audio mix. For example, in some embodiments, the audio mix is included (with corresponding metadata indicative of the currently selected PI, or a sequence of selected PIs) as an object channel in an object based audio program, which can be delivered and then rendered to provide a perception (e.g., rendered for playback by an array of loudspeakers to provide an immersive perception) of action sound emitted at the location on the surface corresponding to the currently selected PI (or at a sequence of locations on the surface corresponding to a sequence of selected PIs).

In some embodiments, step (b) includes steps of operating a graphic user interface to display a representation of the surface and a PI representation (a representation of a selected PI) superimposed on the representation of the surface, and controlling (e.g., manually controlling) the position of the PI representation relative to the representation of the surface to determine a current PI representation position, wherein current PI representation position corresponds to (and determines) the currently selected PI. In some such embodiments, the graphic user interface is implemented on or by a touch screen device (e.g., a tablet computer), or a processing system including a pointing device (e.g., a mouse). In some other embodiments, step (b) is performed using an automated tracking system (e.g., a video camera tracking system) which is configured to identify and track the PI on the surface.

In some embodiments, step (c) includes a step of generating a mix signal (e.g., an analog or digital signal) which is indicative of the audio mix and is suitable for assertion to a broadcasting console as an audio input signal. Many conventional broadcast consoles can accommodate 100 (or more) audio input signals In some embodiments, the microphone array recited in step (a) includes for example subsurface microphones. In other embodiments, the microphone array recited in step (a) includes subsurface microphones and also microphones which are not subsurface microphones. In some embodiments, step (a) includes a step of capturing the action sound using a microphone array including N subsurface microphones (and optionally also other microphones which are not subsurface microphones), where N is a large number. In this context, N is a "large" number in the sense that N microphone outputs are too many outputs to be manually mixed live (e.g., during an event whose action is being captured) by mixing personnel of ordinary skill (e.g., a single skilled human operator or two human operators) using conventional practice. For example, N≥15 is a large number in this context. It is contemplated that in some embodiments in which action sound is captured during a soccer game, the number of subsurface microphones employed in step (a) is in the range from 16 to 50 inclusive (e.g., 32 to 50 inclusive). For capture of action sound during other events (e.g., sporting events on bobsled tracks or other surfaces that are larger than typical soccer fields), the number of subsurface microphones employed in step (a) may be 100 or more.

In some embodiments, two or more PIs on the surface are contemporaneously selected in step (b), the PI data is indicative of two or more currently selected PIs on the surface, and two or more audio mixes are generated in step (c) (i.e., one audio mix for each of the contemporaneously selected PIs). In some embodiments, each audio mix generated in step (c), e.g., a signal indicative thereof, is asserted to a broadcast console.

The inventors have recognized that outputs of multiple microphones under a surface on which an event (e.g., a sporting event) occurs (e.g., microphones buried under the grass of a football field or other playing field), if properly processed, can allow the capture of action sound indicative of spatially localized action during the event (e.g., the sound generated by ball kicks, footsteps, and the like, during a football game), where the action occurs in areas on (e.g., above) the surface where traditional microphones located around the surface (e.g., at the sides and/or ends of the surface) fall short of coverage. The signals from the subsurface microphones, and optionally also signals from microphones located at the sides and/or ends of the surface, may be transmitted separately (wirelessly or via cables) to one or more processing units configured to mix the signals (e.g., to generate a mix which is optimally indicative of the action sound). The processing unit(s) may be configured to output one or multiple audio feeds (e.g., to a broadcast console) or other audio bitstreams, each such feed (or other bitstream) being indicative of a mix of captured action sound emitted during the event, and optionally also position metadata indicative of a location (or sequence of locations) on the surface at which the action sound was emitted.

For example, in some embodiments, a few receiving units are distributed at the event location (e.g., at subsurface locations and/or around the perimeter of the event surface), each configured to receive the output signal(s) of a subset of all the microphones. This could avoid problems due to limited range of wireless transmission, or could facilitate cabling to a main processing unit. Each receiving unit could be a processing unit configured to perform part of the processing, or could just send all the signals to a central processing unit.

In a second class of example embodiments a system is provided for generating a mix indicative of action sound captured at an event on a surface (e.g., a sporting event on a field), including:

a microphone array, including subsurface microphones positioned under the surface, and optionally also at least one additional microphone not positioned under the surface; and a mixing system, including a mixing subsystem coupled to the microphone array, and a point of interest ("PI") selection subsystem coupled to the mixing subsystem, wherein the PI selection subsystem is configured to generate PI data in an automated manner, wherein the PI data is indicative of a currently selected PI on the surface (e.g., PI data indicative of a sequence of PIs, where a most recently selected PI in the sequence is the currently selected PI), and wherein the mixing subsystem is configured to generate, in response to the PI data, an audio mix from outputs of microphones of the array including at least one (typically, more than one) of the subsurface microphones, such that the audio mix is indicative of action sound emitted at the currently selected PI on the surface.

Typically, the microphone array includes a large number of subsurface microphones.

In some embodiments in the second class, the PI selection subsystem implements a graphic user interface, the graphic user interface is configured to display a representation of the surface and a PI representation (a representation of a selected PI) superimposed on the representation of the surface, and to respond to control by a user of the PI representation's position (relative to the representation of the surface) to determine a current PI representation position, and to determine the currently selected PI to correspond to the current PI representation position. In some such embodiments, the PI selection subsystem is a touch screen device (e.g., a tablet computer) configured to implement the graphic user interface such that said graphic user interface is responsive to user touches on a touch screen. In some other embodiments, the PI selection subsystem is a processor (e.g., a portable device) including a pointing device (e.g., a mouse) which can be employed by a user to control the PI representation's position relative to the representation of the surface. In some other embodiments, the PI selection subsystem is or includes an automated tracking system (e.g., a video camera tracking system) configured to identify and track a PI on the surface and to generate the PI data.

In some embodiments in the second class, the mixing subsystem is configured to perform signal processing on individual microphone output signals (from microphones of the microphone array, including at least one of the subsurface microphones) to generate processed microphone signals, and to generate the audio mix from the processed microphone signals in response to the PI data, said signal processing including one or more of: noise reduction; equalization (e.g., to restore high frequency loss due to burying of the subsurface microphones); dynamic range control or limiting (e.g., to avoid unwanted large peaks) and/or other dynamic processing; delay alignment (e.g., of signals from microphones at different distances from a selected PI); and/or voice detection and scrambling of any detected voice (e.g., dialog) content. The mixing subsystem may be configured to output the resulting mix signal in a format (analog or digital) that is suitable for assertion to a broadcasting console.

In a third class of example embodiments a system is provided (e.g., of a type useful as the mixing subsystem of the second class of embodiments) for generating a mix of action sound emitted during an event on a surface, where the action sound was captured at the event using a microphone array including subsurface microphones (e.g. a large number of subsurface microphones) positioned under the surface and optionally also at least one additional microphone not positioned under the surface. In some such embodiments, the system includes a memory, and a mixing subsystem coupled to the memory and configured to generate an audio mix in response to PI data indicative of a currently selected PI on the surface and in response to outputs of microphones of the array including at least one (typically, more than one) of the subsurface microphones, such that the audio mix is indicative of action sound emitted during the event at the currently selected PI on the surface. The memory stores (in a non-transitory manner) data indicative of at least a segment of each of said outputs of microphones of the array including said at least one of the subsurface microphones, or data indicative of at least a segment of a processed version of each of said outputs of microphones of the array including said at least one of the subsurface microphones.

In some embodiments in the third class, the mixing subsystem includes a signal processing subsystem coupled and configured to perform signal processing on the outputs of microphones of the array including said at least one of the subsurface microphones to generate processed microphone signals, and the mixing subsystem is coupled and configured to generate the audio mix in response to the PI data and at least some of the processed microphone signals. In some embodiments, the signal processing includes one or more of: noise reduction; equalization (e.g., to restore high frequency loss due to burying of subsurface microphones); dynamic range control or limiting (e.g., to avoid unwanted large peaks) and/or other dynamic processing; delay alignment; and/or voice detection and scrambling of any detected voice (e.g., dialog) content.

In some embodiments in the third class, the PI data has been generated in response to user manipulation of a touch screen (or other) graphic user interface which displays a representation of the surface, or by a tracking system which implements automatic detection of occurrences during the event (e.g., a ball tracking system which implements "slaved to ball" tracking, including automatic detection of ball location or ball kick locations). The system may be configured to output a mix signal indicative of the audio mix in a format (analog or digital) suitable for assertion to a broadcasting console.

In some example embodiments a method is provided for generation and/or rendering of an object based audio program indicative of an audio object (which is itself indicative of captured action sound emitted at a selected time-varying, or time invariant, PI on a surface), where the program includes at least one object channel indicative of the audio object (and thus indicative of the captured action sound). The program also includes metadata corresponding to the object channel (and indicative of the time invariant or time-varying location of the audio object), so that the program can be rendered (for playback by a speaker array, e.g., a three-dimensional speaker array) to provide a perception of the action sound emitting from the location (e.g., time-varying location) indicated by the metadata (e.g., so that at any instant, the perceived source location of the rendered sound relative to the speaker array corresponds to the location of a time-invariant PI on the surface, or a location along the trajectory of a time-varying PI on the surface). The surface may be a field and the event may be a sporting event. The metadata included in the program typically indicates rendering parameters for rendering the object at an apparent spatial location or along a trajectory (e.g., in a three dimensional volume) corresponding to the action (e.g., using a three-dimensional array of speakers).

Aspects of the example embodiments include methods performed by any embodiment of the inventive system, a system or device configured (e.g., programmed) to perform any embodiment of the inventive method, and a computer readable medium (e.g., a disc) which stores code (e.g., in a non-transitory manner) for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

NOTATION AND NOMENCLATURE

Figure 1:
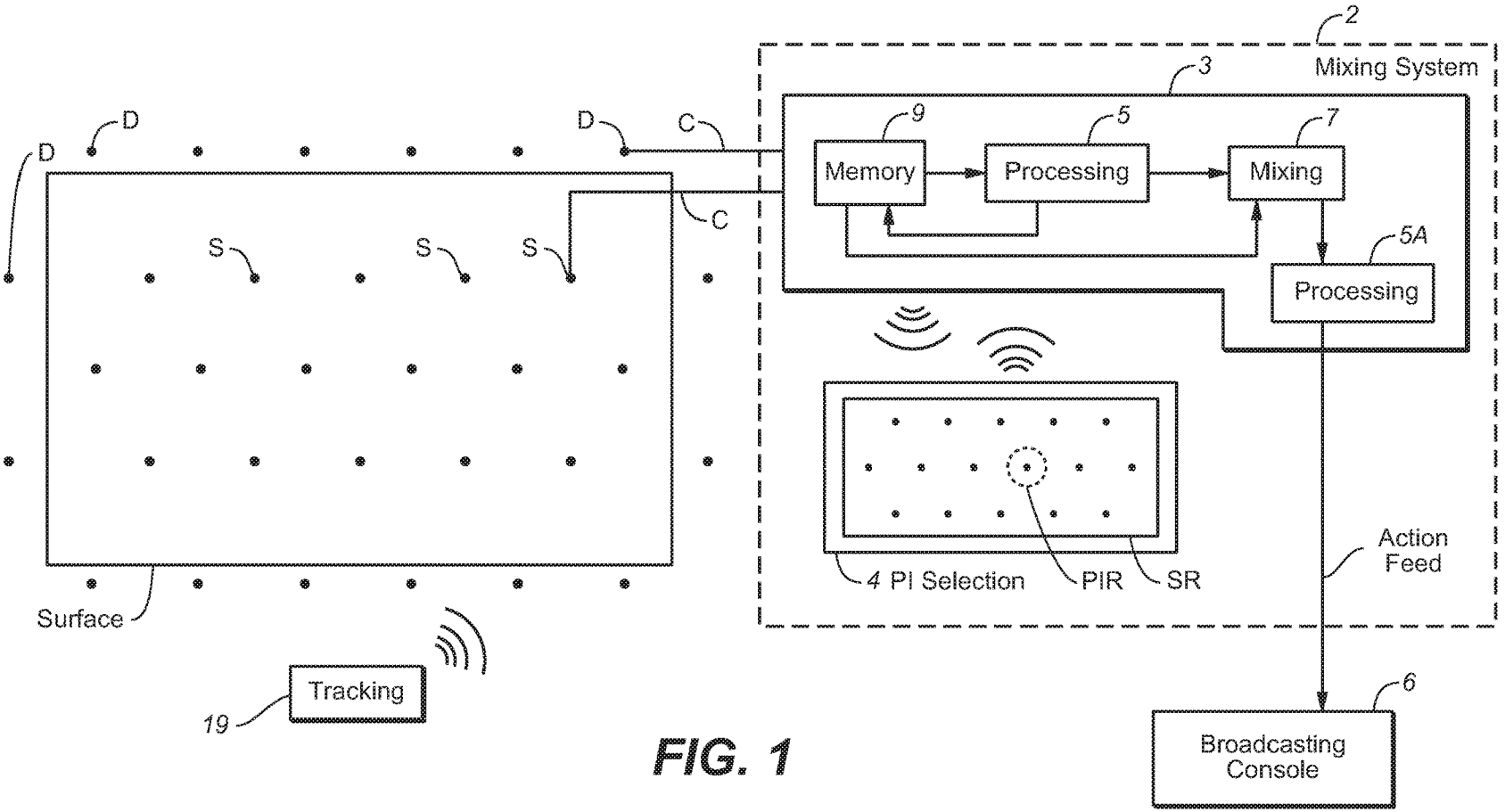
FIG. 1 is a block diagram of a system configured in accordance with example embodiment disclosed herein.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements processing may be referred to as a processing system, and a system including such a subsystem (e.g., a system that generates multiple output signals in response to X inputs, in which the subsystem generates M of the inputs and the other X-M inputs are received from an external source) may also be referred to as a processing system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expression "metadata" refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;

audio program: a set of one or more audio channels (at least one speaker channel and/or at least one object channel) and optionally also associated metadata (e.g., metadata that describes a desired spatial audio presentation);

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source;

object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel); and render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis.

DETAILED DESCRIPTION

FIG. 1 is a block diagram of an embodiment of the inventive system for generating a mix indicative of action sound captured at an event on a surface (identified as "Surface" in FIG. 1). The event may be a game or other sporting event, and the surface may be a field.

The FIG. 1 system includes a microphone array. The array includes fifteen subsurface microphones ("S") positioned under the surface, and twenty additional microphones ("D") which are positioned around the surface (not under the surface). For simplicity, some of the subsurface microphones and some of the additional (non-subsurface) microphones are not specifically labeled in FIG. 1. In a typical implementation, the surface is a sporting field and the subsurface microphones S are buried under the field. In alternative embodiments, the microphone array used to capture action sound (to be mixed in accordance with example embodiments) includes for example subsurface microphones (e.g., the non-subsurface microphones "D" of FIG. 1 are omitted).

The FIG. 1 system also includes mixing system 2, which includes subsystem 3 and point of interest ("PI") selection subsystem 4 coupled (e.g., by a wireless link) to subsystem 3. Subsystem 3 (which itself may be referred to as a mixing subsystem) may be implemented to include signal processing subsystem 5 and mixing subsystem 7 as shown in FIG. 1. Each of the subsurface microphones ("S") and each of the additional microphones ("D") is coupled to subsystem 3 by cables ("C"). Two of the cables are expressly shown in FIG. 1, and others are not shown to simplify the diagram. Alternatively, each of the microphones (S and D) is coupled to subsystem 3 in some other way, e.g., wirelessly. Cables C may deliver analog microphone output signals to subsystem 3, or cables C may be network cables (in which case the microphone output signals would typically be converted from analog to digital form and then transmitted to subsystem 3, individually or in a multiplexed manner, through the network cables). Output signals from two or more microphones may be transmitted to subsystem 3 via one network cable.

In some implementations, the outputs of the microphones (S and D) are coupled to a network (either wired or wireless) configured to provide robust, redundant transmission of the audio content to the mixing system, and optionally also to provide command and control of the individual microphones and any associated equipment from a centralized remote location. The microphone output signals could be transmitted over such a network using "Audio over IP" (AoIP)

techniques. In some implementations, the microphones (S and D) are linked to the mixing system by a cellular or Wi-Fi network.

In a typical implementation, subsystem 3 includes memory 9, signal processing subsystem 5 (coupled to memory 9), and mixing subsystem 7 (coupled to processing subsystem 5). Subsystem 5 is configured to perform signal processing (e.g., as described below) on individual microphone output signals (from microphones of the microphone array, including at least one of subsurface microphones S) to generate processed microphone signals. Subsystem 7 is configured to generate an audio mix in response to processed microphone signals output from subsystem 5 and in response to point of interest ("PI") data from PI selection subsystem 4, such that the audio mix is indicative of action sound emitted at the currently selected PI on the surface. Alternatively, subsystem 5 is omitted, and subsystem 7 is operable to generate an audio mix in response to microphone output signals from microphones of the array including at least one (and typically, more than one) of the subsurface microphones S (e.g., in response to data indicative of such microphone output signals) and in response to PI data from subsystem 4, such that the audio mix is indicative of action sound emitted at the currently selected PI on the surface.

Optionally, subsystem 3 also includes signal processing subsystem 5A, which is configured to perform signal processing (e.g., a subset of the processing operations which would be performed by subsystem 5 if subsystem 5A were omitted) on the audio mix which is output from subsystem 7, and the processed audio mix which is output from subsystem 5A (rather than the audio mix which is output from subsystem 7) is asserted to console 6. Subsystem 5A may be included because some of the signal processing (which could alternatively be performed in subsystem 5) is better done on the mixed signal than on the unmixed input signals. One reason is computational cost. The other reason is that nonlinear processes do not commute with mixing (e.g., one may not know if limiting is needed until a mix has been generated from microphone signals).

Memory 9 (which may be a buffer memory) stores (in a non-transitory manner) data indicative of at least a segment of the output signal of each of the microphones of the array (including the subsurface microphones S). In this context, "segment" of a signal implies that the signal has a duration and denotes a portion of the signal in a time interval, where the time interval is shorter than the duration. Alternatively, memory 9 stores (in a non-transitory manner) data indicative of at least a segment of each of the processed microphone signals output from subsystem 5 (including a processed version of at least one of subsurface microphones S). In other implementations of subsystem 3, memory 9 is not present.

PI selection subsystem 4 is configured to generate the point of interest ("PI") data in an automated manner. The PI data is indicative of a currently selected point of interest ("PI") on the surface (e.g., PI data indicative of a sequence of PIs, where a most recently selected PI in the sequence is the currently selected PI).

In the FIG. 1 embodiment, PI selection subsystem 4 is a touch screen device (e.g., a tablet computer) programmed to implement a graphic user interface. The graphic user interface is configured to display a representation ("SR") of the surface and a PI representation (a representation of a selected PI, identified as "PIR" in FIG. 1) superimposed on the surface representation (SR). A user (e.g., mixing engineer) can select a desired PI on the surface by operating (e.g., touching) the touch screen of the touch screen device to move (e.g., drag) the PI representation ("PIR") to a location on the displayed surface representation (SR) which corresponds to the desired PI (the currently selected PI) on the surface. Subsystem 4 is configured to respond to such control by a user of the PI representation's position (relative to surface representation SR) to determine a current PI representation (PIR) position, to determine the currently selected PI to correspond to the current PIR position, to generate PI data indicative of the currently selected PI, and to assert (e.g., transmit wirelessly) the PI data to subsystem 3.

In some other embodiments, PI selection subsystem 4 is implemented as a processor (e.g., a portable device) including a pointing device (e.g., a mouse) which can be employed by a user to control a displayed PI representation's position relative to a displayed representation of the surface on which the event (whose audio is to be captured) occurs.

In some other embodiments, PI selection subsystem 4 is replaced by or includes an automated tracking system (e.g., a video camera tracking system) configured to identify and track a PI on the surface and to generate PI data indicative of a currently selected PI. Tracking subsystem 19 of FIG. 1 (which is configured to generate PI data and to assert the PI data to subsystem 3 via a wireless link) is an example of such an automated tracking system. Tracking subsystem 19 could replace subsystem 4, or both subsystem 19 and subsystem 4 could operate to assert PI data to subsystem 3 (e.g., with some mechanism operating to give greater priority to the output of subsystem 19 or subsystem 4).

In some implementations, processing subsystem 5 is configured to perform signal processing on individual microphone output signals from microphones of the microphone array (including at least one of the subsurface microphones) to generate processed microphone signals. This signal processing can include one or more of: noise reduction; equalization (e.g., to restore high frequency loss due to burying of the subsurface microphones); dynamic range control or limiting (e.g., to avoid unwanted large peaks) and/or other dynamic processing; delay alignment; and/or voice detection and scrambling of any detected voice (e.g., dialog) content.

Mixing subsystem 7 is configured to output a mix signal (indicative of the audio mix generated by subsystem 7) in a format (analog or digital) that is suitable for assertion to broadcasting console 6. In some embodiments, mixing subsystem 7 also generates (and asserts to console 6) metadata which corresponds to the audio mix and is indicative of the currently selected PI corresponding to each segment of the mix. In some embodiments, console 6 is configured to generate an object based audio program including at least one object channel indicative of an audio object, such that the audio object is indicative of the captured action sound emitted from at least one currently selected PI on the surface. The object channel is determined by (and is itself indicative of) the audio mix and the corresponding metadata output from mixing subsystem 7. Such a program can be rendered (for playback by a speaker array, e.g., a three-dimensional speaker array) to provide a perception of the action sound emitting from the PI location (e.g., time-varying PI location) indicated by the metadata (e.g., so that at any instant, the perceived source location of the rendered sound relative to the speaker array corresponds to the location of a time-invariant PI on the surface, or a location along the trajectory of a time-varying PI on the surface).

In some example embodiments a system (e.g., an implementation of subsystem 3 of FIG. 1) configured to generate a mix of action sound which has been emitted at an event on a surface, where the action sound was captured at the event using a microphone array including subsurface microphones positioned under the surface and optionally also at least one additional microphone not positioned under the surface. In some such embodiments, the system includes a memory (e.g., memory 9 of mixing system 2 of FIG. 1), and a mixing subsystem (e.g., subsystems 5 and 7 of mixing system 2 of FIG. 1) coupled to the memory and configured to generate an audio mix in response to PI data indicative of a currently selected PI on the surface and in response to outputs of microphones of the array including at least one (typically, more than one) of the subsurface microphones, such that the audio mix is indicative of action sound emitted at the currently selected PI on the surface. The memory stores (in a non-transitory manner) data indicative of at least a segment of each of said outputs of microphones of the array including said at least one of the subsurface microphones, or data indicative of at least a segment of a processed version of each of said outputs of microphones of the array including said at least one of the subsurface microphones.

In some embodiments of the inventive system, the mixing subsystem includes a signal processing subsystem (e.g., subsystem 5 of mixing system 2) coupled and configured to perform signal processing on the outputs of microphones of the array including said at least one of the subsurface microphones to generate processed microphone signals, and the mixing subsystem is coupled and configured to generate the audio mix in response to the PI data and at least some of the processed microphone signals. In some embodiments, the signal processing includes one or more of: noise reduction; equalization (e.g., to restore high frequency loss due to burying of subsurface microphones); dynamic range control or limiting (e.g., to avoid unwanted large peaks) and/or other dynamic processing; delay alignment; and/or voice detection and scrambling of any detected voice (e.g., dialog) content. Voice scrambling would typically replace captured real vocal utterances (e.g., dialog) with unintelligible words or phrases while maintaining the feeling and emotional content of, and the intention(s) motivating, the captured voice (e.g., to avoid the problem of unwanted dialog being broadcast). In some embodiments, voice scrambling is performed (e.g., by subsystem 5 of FIG. 1) when needed, either in a manner controlled manually, or automatically via an automatic real-time speech recognition system.

In some embodiments of the inventive system, the PI data has been generated in response to user manipulation of a touch screen (or other) graphic user interface which displays a representation of the surface, or by a tracking system which implements automatic detection of occurrences during the event (e.g., a ball tracking system which implements "slaved to ball" tracking, including automatic detection of ball location or ball kick locations). The system may be configured to output a mix signal indicative of the audio mix in a format (analog or digital) suitable for assertion to a broadcasting console.

The inventors have recognized that it is often preferable that a microphone array employed to capture action sound (to be mixed in accordance with example embodiments) includes N subsurface microphones (and optionally also other microphones which are not subsurface microphones), where N is a large number. In this context, a "large" number of microphones denotes a number of microphones that is too large for the outputs of said microphones to be manually mixed live (i.e., during an event whose action is being captured) by mixing personnel of ordinary skill (e.g., a single skilled human operator or two human operators) using conventional practice. For example, N≥15 is a large number in this context. It is contemplated that in some embodiments in which action sound is captured during a soccer game, the number of subsurface microphones employed is in the range from 16 to 50 inclusive (e.g., 32 to 50 inclusive). For capture of action sound during other events (e.g., sporting events on bobsled tracks or other surfaces that are larger than typical soccer fields), the number of subsurface microphones employed may be 100 or more.

The inventors have recognized that subsurface microphones positioned in a triangular tiling pattern under a field (or other event surface) desirably provides a greater fill factor (greater coverage) of the event surface than would the same number of subsurface microphones arranged in a rectangular tiling pattern (e.g., 91% for triangular tiling versus 78% for rectangular tiling).

Figure 2:
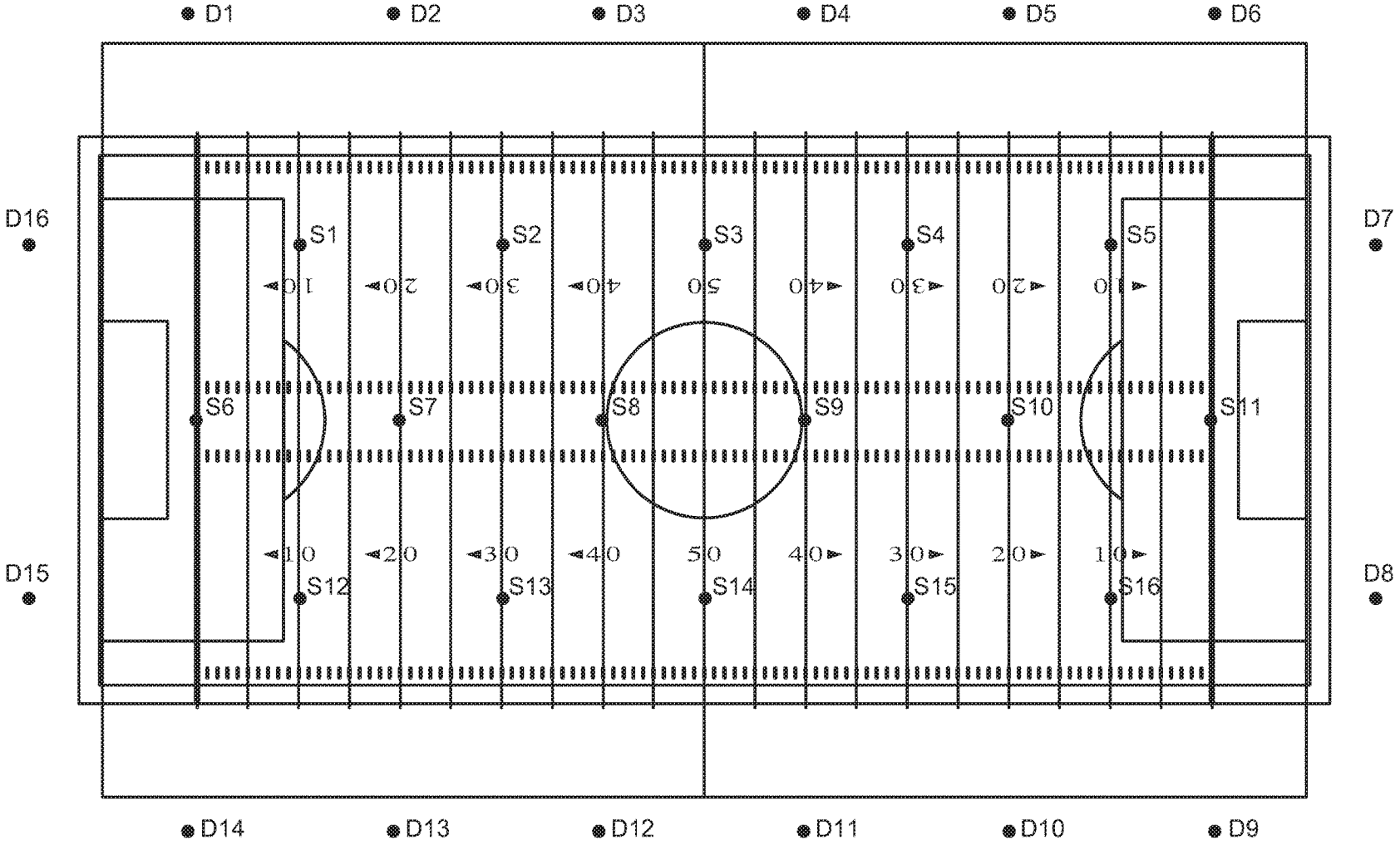
FIG. 2 is a diagram showing placement of microphones (including subsurface microphones) to capture action sound emitted during a soccer game or American football game on a field in accordance with an example embodiments disclosed herein.

FIG. 2 is a diagram showing placement of microphones (including a large number of subsurface microphones) to capture action sound emitted during a soccer game or American football game on a field (sometimes referred to as a pitch) in accordance with a example embodiments. As shown in FIG. 2, sixteen subsurface microphones S1-S16 are arranged (i.e., buried) in a triangular fill pattern under the field, and sixteen additional microphones D1-D16 are positioned around (not under) the field, with microphones D7, D8, D15, and D16 at the ends of the field, and microphones D1-D6 and D9-D14 along the sides of the field.

In another preferred embodiment, for capture of action sound during a soccer game on a field (pitch), N subsurface microphones (where N is a number equal, or substantially equal, to 30) are buried under the field, in a pattern that ensures uniform coverage of inner areas of the field (e.g., in a triangular tiling pattern). The subsurface microphones are connected to a mixing system either wirelessly, or with individual microphone cables, or with network cables (in this case the microphone output signals would typically be converted from analog to digital form and then transmitted, individually or in a multiplexed manner, through the network cables). A number (at least substantially equal to 12) of standard directional microphones located around (i.e., not under) the field and pointing inwards are also coupled to the mixing system. In the mixing system, the individual microphone output signals (from the subsurface microphones and other microphones) are processed (before undergoing mixing), for example, to perform thereon one or more of:

- noise reduction;
- equalization (e.g., to restore high frequency loss due to burying of the subsurface microphones);
- dynamic range control or limiting (e.g., to avoid unwanted large peaks) and/or other dynamic processing; and/or
- voice detection (e.g., dialog detection) and scrambling of detected voice (e.g., dialog) content.

In the mixing system, processed microphone output signals are then mixed in response to point of interest ("PI") data of any of the types described herein. The PI data may have been generated in response to operator manipulation of a touch screen (or other) user interface, or by a tracking system which implements automatic detection of occurrences during the event (e.g., a ball tracking system which implements "slaved to ball" tracking, including automatic detection of ball location or ball kick locations). The mixing system may output a mix signal indicative of the audio mix in a format (analog or digital) that is suitable for assertion to a broadcasting console.

Figure 3:
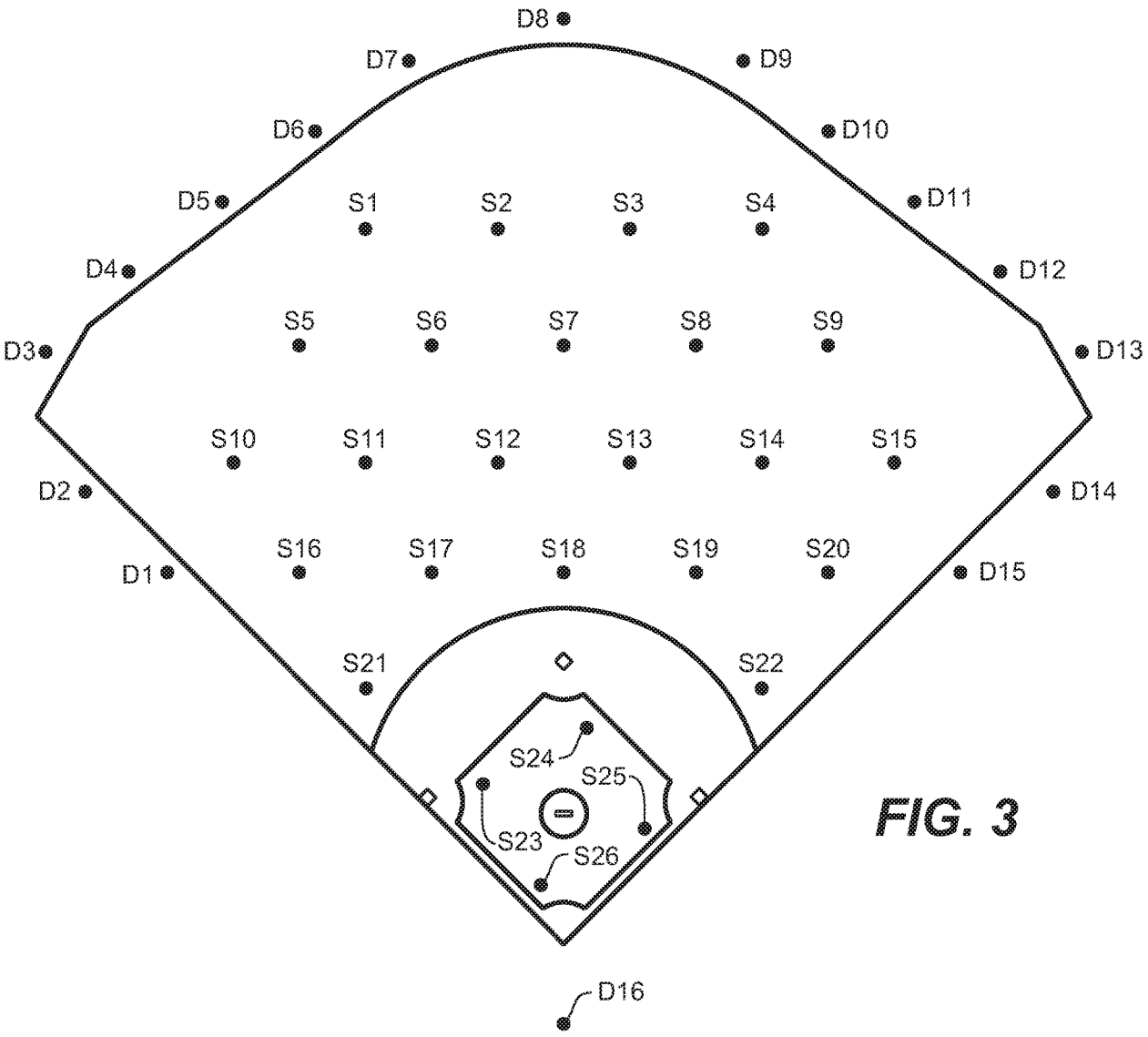
FIG. 3 is a diagram showing placement of microphones (including subsurface microphones) to capture action sound emitted during a baseball game on a field in accordance with example embodiment disclosed herein.

It is also contemplated that microphones (including subsurface microphones) be used to capture action sound emitted during events other than football or soccer games in accordance with example embodiments. For example, in one embodiment, action sound is captured during a baseball game on a baseball field using a microphone array as shown in FIG. 3. The array of FIG. 3 comprises twenty-two subsurface microphones (S1-S22) arranged (i.e., buried) in a triangular fill pattern under the outfield portion of the field (i.e., under grass of the baseball field), four additional subsurface microphones (S24-S26) arranged (e.g., buried) under the infield portion of the field (i.e., under grass of the infield), and fifteen additional microphones (D1-D15) positioned around the outer (outfield) edge of the baseball field.

In a class of example embodiments a method is provided for generating a mix indicative of action sound captured at an event on a surface (e.g., a sporting event on a field), including steps of:

(a) capturing the action sound using a microphone array (e.g., the microphone array of FIG. 1 or FIG. 2), said array including subsurface microphones (e.g., a large number of subsurface microphones) positioned under the surface;

(b) in an automated manner (e.g., by operation of subsystem 4 or 19 of FIG. 1), selecting at least one point of interest ("PI") on the surface and generating PI data indicative of a currently selected PI on the surface (e.g., selecting a sequence of PIs on the surface, and generating the PI data to be indicative of the sequence of PIs, where a most recently selected PI in the sequence is the currently selected PI); and (c) in response to the PI data, generating (e.g., in system 2 of FIG. 1) an audio mix from outputs of the microphones including at least one (e.g., more than one) of the subsurface microphones, such that the audio mix is indicative of action sound emitted at the currently selected PI on the surface.

Typically, the audio mix can be rendered (for playback by a loudspeaker or loudspeaker array) to provide a perception of action sound (captured by at least one of the subsurface microphones) emitted at the spatial location the surface corresponding to the currently selected PI (or a sequence of spatial locations corresponding to a sequence of selected PIs). Typically, the audio mix is a mono mix. Some embodiments include a step of generating (e.g., in broadcast console 6 of FIG. 1 or another broadcast console) an audio program including audio content indicative of the audio mix. For example, in some embodiments, the audio mix is included (with corresponding metadata indicative of the currently selected PI, or a sequence of selected PIs) as an object channel in an object based audio program, which can be delivered and then rendered to provide a perception (e.g., rendered for playback by an array of loudspeakers to provide an immersive perception) of action sound emitted at the location on the surface corresponding to the currently selected PI (or at a sequence of locations on the surface corresponding to a sequence of selected PIs).

In some embodiments, step (b) includes steps of operating a graphic user interface (e.g., a user interface implemented using a touch screen, as in subsystem 4 of FIG. 1) to display a representation of the surface (e.g., "SR" displayed by subsystem 4 of FIG. 1) and a PI representation (a representation of a selected PI) superimposed on the representation of the surface, and controlling (e.g., manually controlling) the position of the PI representation (e.g., the position of "PIR" displayed by subsystem 4 of FIG. 1) relative to the representation of the surface to determine a current PI representation position, wherein current PI representation position corresponds to (and determines) the currently selected PI. In some such embodiments, the graphic user interface is implemented on or by a touch screen device (e.g., a tablet computer), or a processing system including a pointing device (e.g., a mouse). In some other embodiments, step (b) is performed using an automated tracking system (e.g., subsystem 19 of FIG. 1, which may be implemented as a video camera tracking system) which is configured to identify and track the PI on the surface.

In some embodiments, step (c) includes a step of generating (e.g., in subsystem 7 of FIG. 1) a mix signal (e.g., an analog or digital signal) which is indicative of the audio mix and is suitable for assertion to a broadcasting console (e.g., console 6 of FIG. 1) as an audio input signal. Many conventional broadcast consoles can accommodate 100 (or more) audio input signals In some embodiments, two or more PIs on the surface are contemporaneously selected in step (b) (e.g., by an implementation of PI selection subsystem 4 and/or subsystem 19 of FIG. 1), the PI data is indicative of two or more currently selected PIs on the surface, and two or more audio mixes are generated in step (c) (i.e., one audio mix for each of the contemporaneously selected PIs). In some embodiments, each audio mix generated (e.g., by mixing subsystem 7 of FIG. 1) in step (c), e.g., a signal indicative of each such audio mix, is asserted to a broadcast console. For example, an implementation of processing subsystem 5 of FIG. 1 is configured to receive a large number of microphone output signals, and to apply signal processing of at least one type to each microphone output signal to generate processed microphone signals, and mixing subsystem 7 of FIG. 1 is implemented to generate one audio mix (or two, three, four, or five audio mixes) in response to the processed microphone signals (and PI data), and to assert each audio mix to broadcast console 6.

In some embodiments, an audio program (including audio content indicative of a mix of action sound captured during an event on a surface) is generated (e.g., by the FIG. 1 system), including by combining outputs of subsurface microphones to generate the mix (e.g., during real-time mixing, using advanced signal processing) in a fully-automated or semi-automated way, such that the program can be rendered (for playback by a speaker or speaker array) to provide a perception of spatially localized action (e.g., action at spatial location or along a trajectory) during the event. In some embodiments, the program is an object based audio program including at least one object channel (and related metadata) indicative of the mix.

The inventors have recognized that outputs of multiple microphones under a surface on which an event (e.g., a sporting event) occurs (e.g., microphones buried under the grass of a football field or other playing field), if properly processed, can allow the capture of action sound indicative of spatially localized action during the event (e.g., the sound generated by ball kicks, footsteps, and the like, during a football game), where the action occurs in areas on (e.g., above) the surface where traditional microphones located around the surface (e.g., at the sides and/or ends of the surface) fall short of coverage. The signals from the subsurface microphones, and optionally also signals from microphones located at the sides and/or ends of the surface, may be transmitted separately (wirelessly or via cables) to a processing unit (e.g., subsystem 3 of FIG. 1) configured to mix the signals (e.g., to generate a mix which is optimally indicative of the action sound). The processing unit may be configured to output one or multiple audio feeds (e.g., to a broadcast console) or other audio bitstreams, each such feed (or other bitstream) being indicative of a mix of captured action sound emitted during the event, and optionally also position metadata (e.g., PI data) indicative of a location (or sequence of locations) on the surface at which the action sound was emitted.

In typical example embodiments disclosed herein, the embodiments includes or employs at least one of the following elements:

subsurface microphones under an event surface (e.g., buried under a field on which an event occurs). The subsurface microphones may be arranged in a regular or irregular grid;

output signals of subsurface microphones may be transmitted in one of the following ways: via standard cables buried underground; wirelessly, each microphone having a battery-powered transmitter and using a specific frequency of the spectrum; or wirelessly per zones (several microphones are grouped together via cables or a closed wireless network. Each group has a transmitter which multiplexes their signals and transmits them wirelessly or with fewer cables);

a subsystem (e.g., implemented in hardware) configured to collect the output signals of the microphones and perform thereon at least one of the following operations:

- Pre-amplification of analog microphone signals, or reception of wireless signals, or de-multiplexing of multiplexed signals;
- Noise reduction;
- EQ (equalization) to restore timbre of underground microphones;
- Dynamic compression/limiting to maintain level consistence;
- Delay alignment of signals from multiple spaced microphones (e.g., signals from microphones at different distances from a selected PI);
- Mixing of the signals based on one or multiple specified points of interest (PIs); and/or
- Output of one mixed signal per PI, corresponding to and indicative of action sound emitted at the PI;

automation of selection of each PI, e.g., by a tablet application where a human user employs a graphic user interface to move the PI in real-time, or via slaving to an external tracking system. The mixing process is based on the current position of the PI.

In some example embodiments, the embodiments implements at least one of the following features:

- action sound is captured during events other than sporting events on fields, where it is desirable to capture action sound in locations that are not accessible to traditional microphones;
- the tracking of the PI is slaved to automatic detection of audio events (e.g. a kick of the ball, or a starter gun);
- Automatic calibration of microphone (e.g., subsurface microphone) gains (e.g., using sound emitted from a venue Public Address system before a game);
- Defining and outputting multiple points of interest (PIs);
- Outputting positional metadata (e.g., PI data) indicative of each selected PI.

Noise reduction on subsurface microphone outputs is expected to be necessary in many cases. Subsurface microphones will typically capture much noise at all times during operation. The noise reduction signal processing would typically be performed consistently on all subsurface microphone outputs (so that the noise-reduced signals would be indicative of similar sounds, and hence could be mixed).

When rendered, the output of an underground microphone would typically sound heavily filtered (due to the material above and around an underground microphone) unless appropriate signal processing is performed thereon. Outputs of different subsurface microphones might sound very differently when rendered unless equalization is performed thereon, which can be a great problem when they are mixed automatically. Therefore, automatic equalization would typically be performed on such outputs, to make the equalized outputs sound similarly.

Action sounds will typically arrive to different buried microphones with similar loudness but different times of arrival. Thus, a time-compensation signal processing stage (implemented, for example, by subsystem 5 of FIG. 1) may be employed.

In some embodiments, the inventive system is implemented to be easily reconfigurable, for example, so that the system (including the display generated by the graphic user interface of the PI selection subsystem) can be reconfigured when one of the microphones is detected to be malfunctioning. For example, a manual or automatic detection that one microphone is not functioning properly might trigger reconfiguration, and the reconfiguration might include automatic recalculation of optimal microphone gains needed to capture sound from a selected PI on the event surface.

In some embodiments, gains are applied to individual microphone outputs as part of the mentioned signal processing (before mixing). This could be performed in a separate gain stage so as to enable, for example, automatic calibration of microphone signals or compensation of unwanted losses which may occur over time.

In typical embodiments, underground microphones and their related electronics are properly protected from atmospheric conditions (e.g. with waterproof, acoustically semi-transparent capsules).

Example embodiments disclosed herein may be implemented in hardware, firmware, or software, or a combination thereof. For example, subsystem 3 or subsystem 4 of FIG. 1 may be implemented in appropriately programmed (or otherwise configured) hardware or firmware, e.g., as a programmed general purpose processor, digital signal processor, or microprocessor. Unless otherwise specified, the algorithms or processes included as part of the example embodiments are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the point of interest selection, audio signal processing, mixing, and audio program generation operations of example embodiments may be implemented in one or more computer programs executing on one or more programmable computer systems, each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of the example embodiments may be implemented by multi-threaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing in a non-transitory manner) a computer program, where the storage medium so configured causes a computer system to operate in a specific and predefined manner to perform the functions described herein.

A number of example embodiments have been described. It should be understood that various modifications may be made without departing from the spirit and scope of the example embodiments disclosed herein. Numerous modifications and variations of the example embodiments are possible in light of the above teachings. It is to be understood that within the scope of the appended claims, the example embodiments may be practiced otherwise than as specifically described herein.

What is claimed is:

1. A method for generating a mix indicative of action sound captured at an event on a surface, including:

capturing the action sound using a microphone array, said array including N subsurface microphones positioned under the surface, wherein the subsurface microphones are positioned in a triangular tiling pattern under the surface such that respective three adjacent subsurface microphones form vertices of an equilateral triangle;

selecting, by one or more processors, at least one point of interest, "PI", on the surface, operating, by the one or more processors, a graphic user interface to display a representation of the surface and a PI representation superimposed on the representation of the surface, controlling, by the one or more processors, the PI representation's position relative to the representation of the surface to determine a current PI representation position, wherein the current PI representation position corresponds to and determines the currently selected PI, generating, by the one or more processors, PI data indicative of a currently selected PI on the surface; and in response to the PI data, generating an audio mix from outputs of the microphones including at least one of the subsurface microphones, such that the audio mix is indicative of action sound emitted at the currently selected PI on the surface.

2. The method of claim 1, wherein N≥15.

3. The method of claim 1, wherein the microphone array also includes microphones which are not subsurface microphones.

4. The method of claim 1, wherein the event is a sporting event, and the surface is a field.

5. The method of claim 1, also including a step of generating, by the one or more processors, an audio program including audio content indicative of the audio mix.

6. The method of claim 1, wherein also including:

performing, by the one or more processors, signal processing on microphone output signals from microphones of the microphone array, including at least one of the subsurface microphones, to generate processed microphone signals wherein the audio mix is generated from the processed microphone signals in response to the PI data, wherein the signal processing includes at least one of noise reduction, or equalization, or dynamic range control, or limiting, or delay alignment, or scrambling of detected voice content.

7. A system for generating a mix indicative of action sound captured at an event on a surface, said system including:

a microphone array, including N subsurface microphones positioned under the surface, wherein the subsurface microphones are positioned in a triangular tiling pattern under the surface such that respective three adjacent subsurface microphones form vertices of an equilateral triangle; and a mixing system, including a mixing subsystem coupled to the microphone array, and a point of interest, "PI", selection subsystem coupled to the mixing subsystem, wherein the PI selection subsystem is configured to generate PI data, the PI data is indicative of a currently selected PI on the surface, and the mixing subsystem is configured to generate, in response to the PI data, an audio mix from outputs of microphones of the array including at least one of the subsurface microphones, such that the audio mix is indicative of action sound emitted at the currently selected PI on the surface, wherein the PI selection subsystem implements a graphic user interface, the graphic user interface is configured to display a representation of the surface and a PI representation superimposed on the representation of the surface, and to respond to control by a user of the PI representation's position relative to the representation of the surface to determine a current PI representation position, and to determine the currently selected PI to correspond to the current PI representation position, and wherein each of the mixing subsystem and the PI selection subsystem includes one or more processors.

8. The system of claim 7, wherein N≥15.

9. The system of claim 7, wherein the microphone array also includes microphones which are not subsurface microphones.

10. The system of claim 7, wherein the event is a sporting event, and the surface is a field.

11. The system of claim 7, wherein the one or more processors are configured to perform operations of generating an audio program including audio content indicative of the audio mix.

12. The system of claim 7, wherein the mixing subsystem is configured:

to perform signal processing on microphone output signals from microphones of the microphone array, including at least one of the subsurface microphones, to generate processed microphone signals, and to generate the audio mix from the processed microphone signals in response to the PI data, wherein the signal processing includes at least one of noise reduction, or equalization, or dynamic range control, or limiting, or delay alignment, or scrambling of detected voice content.

13. A system for generating a mix of action sound which has been emitted during an event on a surface, where the action sound was captured using a microphone array including N subsurface microphones positioned under the surface, wherein the subsurface microphones are positioned during the event in a triangular tiling pattern under the surface such that respective three adjacent subsurface microphones form vertices of an equilateral triangle, said mixing system including:

a non-transitory memory; and a mixing subsystem coupled to the memory and configured to generate an audio mix in response to point of interest, "PI", data indicative of a currently selected PI on the surface and in response to outputs of microphones of the array including at least one of the subsurface microphones, such that the audio mix is indicative of action sound emitted during the event at the currently selected PI on the surface, wherein the memory stores data indicative of at least a segment of each of the outputs of microphones of the array including said at least one of the subsurface microphones, or data indicative of at least a segment of a processed version of each of said outputs of microphones of the array including said at least one of the subsurface microphones, wherein the system further comprises a PI selection subsystem coupled to the mixing subsystem, and the PI selection subsystem implements a graphic user interface, the graphic user interface is configured to display a representation of the surface and a PI representation superimposed on the representation of the surface, and to respond to control by a user of the PI representation's position relative to the representation of the surface to determine a current PI representation position, and to determine the currently selected PI to correspond to the current PI representation position, and wherein each of the mixing subsystem and the PI selection subsystem includes one or more processors.

14. The system of claim 13, wherein the mixing subsystem includes: a signal processing subsystem coupled and configured to perform signal processing on the outputs of microphones of the array including said at least one of the subsurface microphones to generate processed microphone signals, wherein the mixing subsystem is coupled and configured to generate the audio mix in response to the PI data and at least some of the processed microphone signals, and wherein the signal processing includes at least one of noise reduction, or equalization, or dynamic range control, or limiting, or delay alignment, or scrambling of detected voice content.

15. The system of claim 13, wherein $N \geq 15$.

16. The system of claim 13, wherein the microphone array also includes microphones which are not subsurface microphones.

17. The system of claim 13, wherein the event is a sporting event, and the surface is a field.

* * * * *